United States Patent [19]

Vlahakis

[11] 4,096,593

[45] Jun. 27, 1978

[54] TOILET BOWL DISPENSER

[76] Inventor: Eftichios Van Vlahakis, 2423 The Strand, Northbrook, Ill. 60062

[21] Appl. No.: 705,598

[22] Filed: Jul. 15, 1976

[51] Int. Cl.[2] ..... E03D 9/02; A61L 9/04

[52] U.S. Cl. ..... 4/231

[58] Field of Search ..... 4/109, 121, 223, 224, 4/229, 231, 232; 239/36, 310; 222/187

[56] References Cited

U.S. PATENT DOCUMENTS

| | | | |
|---|---|---|---|
| 1,210,650 | 1/1917 | Hunt | 4/231 |
| 1,880,912 | 10/1932 | Duwelius | 4/231 |
| 3,597,772 | 8/1971 | Levitt et al. | 4/222 |
| 3,675,254 | 7/1972 | Brownstein | 4/231 |
| 3,766,576 | 10/1973 | Ancel | 4/231 |
| 3,947,901 | 4/1976 | Willert | 4/231 |

*Primary Examiner*—Richard E. Aegerter
*Assistant Examiner*—Stuart S. Levy
*Attorney, Agent, or Firm*—Jacques M. Dulin

[57] ABSTRACT

Improved dispenser assembly for controlled release of bactericidal, detergent and aromatic agents upon flushing, which dispenser clips onto the upper edge of a toilet bowl. The assembly is specially adapted to bring a solid type deodorant/disinfectant cake into position along the side wall of the bowl but below the rim so that upon flushing, the flush water is directed to the cake in a turbulent action that releases limited amount of the cake. The dispenser disposes the cake above the bowl water line, and shields it from urine or splash so that it does not dissolve too rapidly.

6 Claims, 4 Drawing Figures

TOILET BOWL DISPENSER

FIELD

This invention is directed to improvements in dispensers for solid, but water-soluble, deodorant/bactericidal-type toilet bowl dispensers. More particularly, the invention relates to unitary plastic dispensers adapted to clip on the inside of the rim of the toilet bowl itself in a manner to permit sustained and controlled release of the deodorant/bactericide into the bowl only upon flushing.

BACKGROUND

Most toilet-type disinfectant/deodorants are applied in the water tank. These may be of liquid or solid, but water-soluble type. A major disadvantage of these, particularly the solid type is that they are in continuous contact with water and tend to dissolve too quickly.

The in-the-bowl type of solid units tend to be blocks having wires embedded therein that slip onto the inner bowl rim. These are exposed to the water and urine, and also dissolve too quickly, and not in response to flush water only. A more complex, multi-part type dispenser is shown in U.S. Pat. Nos. 3,538,520 and 3,597,772. These, however, are costly to manufacture as they are multi-part. In addition, they have ends exposed, and may swing away from position adjacent the side wall as they are hinged.

Accordingly, there is need for an improved, one-piece dispenser for solid-type, deodorant/disinfectant blocks that clip onto the bowl rim, which are adapted to dispose the block for flush-only dissolution in a controlled manner, and which shield the block from spash or urine.

THE INVENTION

OBJECTS

It is an object of this invention to provide an improved toilet bowl dispenser for controlled dispensing of solid, block-type disinfectant/deodorant upon flushing of the toilet.

It is another object to provide an improved toilet bowl dispenser that is of one-piece, unitary construction, and can be molded of plastic.

It is another object to provide a disposable toilet bowl dispenser that clips onto the toilet bowl rim.

It is another object to provide a toilet bowl dispenser adapted to retain a solid, block-type disinfectant adjacent an inside wall of the toilet bowl above the water line, but in position to permit turbulent washing action across a surface of the block during flushing.

It is another object to provide a unitary toilet bowl dispenser that also acts as the mold for casting molten disinfectant/deodorant material therein which solidifies to a solid block in the dispenser, thereby simplifying manufacture.

Still other objects will be evident from the drawings and description.

FIGURES

The description which follows has reference to the drawings in which.

SUMMARY

Unitary plastic toilet bowl dispenser having means adapted to clip on the inside upper rim of a toilet bowl, and having a depending member disposed at an angle thereto to bias a generally semi-circular cup member with its open face toward the toilet bowl wall. A lower lip conforms to the inside of the bowl wall and spaces the upper rim of the cup from the wall to provide a channel for flush water to flow downwardly into contact with a solid disinfectant/deodorant block disposed in and retained by the cup. The flush water may escape along the sides of the dispenser. The dispenser also has end walls preformed thereinto and means for retaining the solid disinfectant. This permits direct casting of the disinfectant into the cup without resort to special molds. The dispenser is adapted to retain the block of disinfectant above the waterline and to protect the bowl center-facing sides of the block and the ends from water splash and urine. These adaptations permit controlled dissolution of the block only when required, e.g., upon flushing. The water directing means of the dispenser assures adequate and even block dissolution.

DETAILED DESCRIPTION

The detailed description of the preferred embodiment which follows is by way of specific example and not by way of limitation of the principles of the invention.

Figure 1:
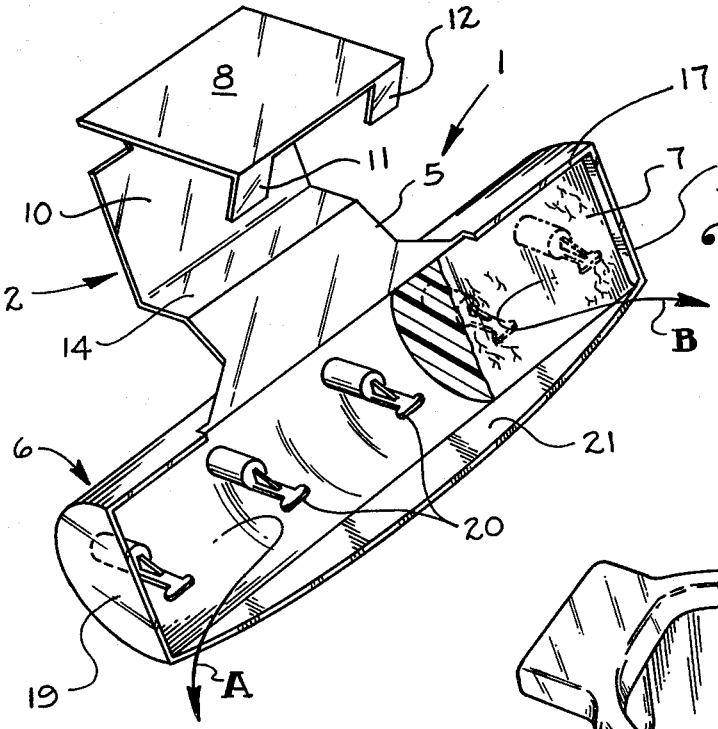
FIG. 1 is a perspective view of the dispenser showing disposition of the solid deodorant/disinfectant material as cast therein.
Figure 2:
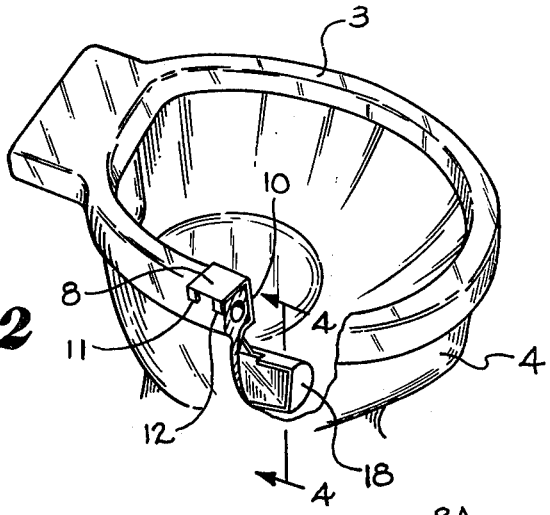
FIG. 2 is a perspective view of the dispenser in its use position in a toilet bowl, with a portion of the bowl broken away to reveal the surface of the solid block.

Referring first to FIG. 1, dispenser 1 comprises an upper member 2 defining means for clipping the dispenser onto the rim 3 of a toilet bowl 4 (seen best in FIGS. 2 and 4), depending web 5, and a cup member 6 for retaining solid, block-type disinfectant 7.

Figure 3:
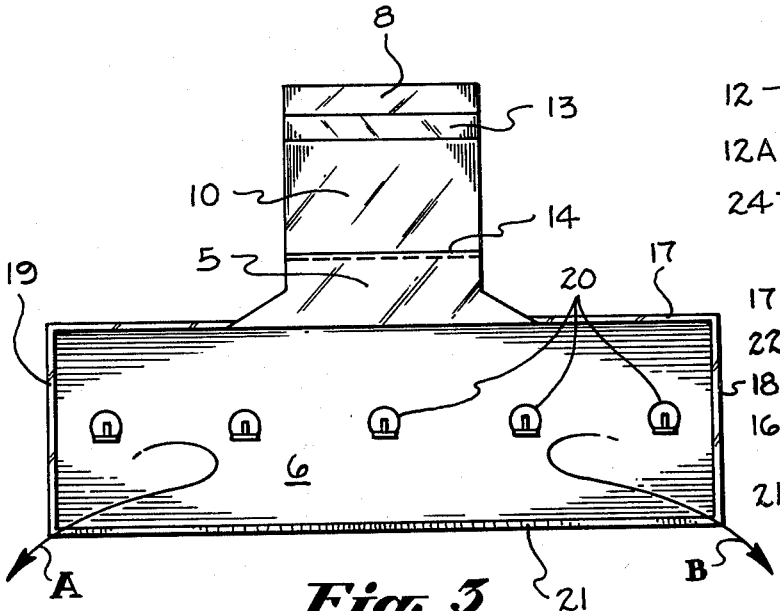
FIG. 3 is a front view of the inside of the dispenser.

The clip-on member 2 comprises a top retaining plate member 8 joined at an acute angle 9 to a vertical inner wall member 10. The clip on member is restrained from lateral motion, falling off the rim by tabs 11, 12 (FIGS. 1 and 2) or lip 13 (FIG. 3). Lower plate 14 completes the clip-on member and forms, between plates 8 and 14 and wall 10, a generally C-shaped hanger having at the upper edge the retaining tabs 11, 12 or lip 13.

Figure 4:
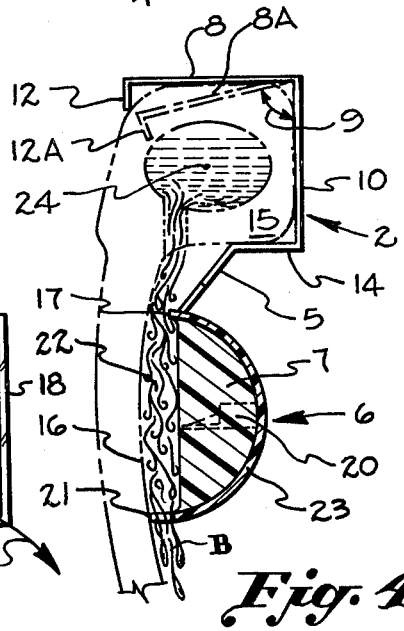
FIG. 4 is a section view of the dispenser in it use position taken along line 4–4 of FIG. 3.

The upper plate is canted downwardly in its original, as-received position, as shown at 8A in phantom in FIG. 4. This provides a positive vertical clamping action on the inner bead 15 of the toilet bowl. Further, it is a universal feature, permitting compensation for varying rim bead size, yet securely clamping the dispenser thereto. The angle also provides relative lateral displacement of the tab 12 with respect to the initial position 12A, whereby conpensating for varying widths of rims. This clip-on member permits ease of mounting and removal of the dispenser assembly.

The web 5 depends from the bottom plate 14 and is disposed at an angle projecting outwardly from the bowl center, as best seen in FIG. 4. This acts to bias cup 6 against the inner wall 16 of the bowl rim.

The cup as shown in this embodiment is generally C-shaped in cross section, with the upper edge 17 being spaced from wall 16, as best seen in FIG. 4. This permits water 24 to flow down into contact with block material 7 upon flushing. The web 5 also helps to guide the water into contact with block 7.

The cup has end retaining walls 18, 19 which serve the plural functions of retaining the water for contact with the block, and permit direct casting of the molten disinfectant/deodorant/detergent block into the cup without need for a separate mold or plural assembly steps. Prongs 20 assist in retaining the block in the cup upon solidification of the molten disinfectant upon cooling after casting.

Lower lip 21 is preferably curved to follow the curved inner wall 16 of the bowl. This also assists in detaining the water in its downward flow, causing turbulence 22 (in FIG. 4) and flow of the water toward each end of the dispenser as best shown by arrows A and B in FIGS. 1, 3 and 4.

In combination, these features provide controlled, uniform dispensing of the water-soluble disinfectant block material from the cup. The outer cup wall 23 and ends 18, 19 shield the block from fluid action other than the flush water 18. This prolongs the block life and permits dissolution only when needed, upon use.

Any conventional detergent/disinfectant/deodorant block material may be used. A convenient composition is that shown in U.S. Pat. No. 3,824,633, which composition is incorporated by reference herein. Generally, it is a para-dichlorobenzene type, containing fluid-soluble chemicals for selectively dispensing upon contact with solvents for the chemicals. A typical composition for a fluid-soluble chemical may include non-ionic surfactants containing a high percentage of ethylene oxide in sufficient quantity to have a melting point above approximately 100° F. Water-soluble polymeric materials of relatively high melting point may then be added as desired to control the melting point of the fluid-soluble chemical so that it can be assured that the chemical will not melt at ambient use temperatures, but will dissolve in the wash or feed water at the required rate.

In addition to the non-ionic surfactants, acids, such as phosphoric and citric, may be employed in the chemical composition to produce a low pH to neutralize urine bases and form soluble, noncorrosive urine salts. Essential oils and colorants may also be added to enhance the odor characteristics and physical appearance of the product. Germicidal components are preferably added to reduce the bacterial count on urinal surfaces.

The dispenser may be manufactured from any type of plastic, conveniently by injection molding a polyolefin such as polystyrene, polypropylene, polyethylene, co- or ter-polymers and the like. The melting point of the polymer should be above that of the block material, so that molten block material may be cast directly into the cup.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

I claim:

1. An improved toilet bowl dispenser comprising in operative combination:

(a) means for removably retaining said dispenser on the inner rim of a toilet bowl comprising a clip-on member having a top member, a bottom member, a generally vertical wall member joining said top and said bottom, lateral retaining means depending from said top member, said top member being disposed at an acute angle to said wall member to provide positive vertical clamping action to said rim between said top and bottom members for universal fit and secure retention of said dispenser on rims of varying size and to maintain a disinfectant material retaining means above the normal water level in said bowl;

(b) means for retaining said disinfectant material disposed below said rim in the path of flush water dispensed from said rim comprising a member generally cup-shaped in cross section with imperforate end walls for permitting direct casting of said disinfectant material thereinto, said cup having an opening oriented generally facing an inner wall of said bowl to protect said disinfectant material from dissolving by water other than said flush water, said cup having an upper edge portion spaced from said inner wall of said bowl to provide space for flush water to flow downwardly into contact with said disinfectant material disposed in said cup, and a lower portion of said cup including means extending into contact with said bowl inner wall to space said upper edge portion from said wall and for detaining the downward flow of water into said bowl to provide even dissolution of said disinfectant material along its length; and (c) means for urging said disinfectant-retaining cup means against said inner wall of said toilet bowl, said urging means connecting said cup means and said removable retaining means.

2. An improved dispenser as in claim 1 wherein said retaining means cup includes means disposed projecting from an inner surface of said cup for assisting in retaining said disinfectant material therein.

3. An improved dispenser as in claim 2 wherein said cup is imperforate.

4. An improved dispenser as in claim 2 wherein said disinfectant material has a generally vertical exposed face oriented towards and spaced from said bowl inner wall.

5. An improved dispenser as in claim 4 wherein said lip is arcuate in shape, and a center portion of said arc contacts said inner wall of said bowl.

6. An improved dispenser as in claim 1 wherein said lower edge portion extending means comprises a continuous lip extending between said endwalls of said cup.

* * * * *